US007396152B2

(12) United States Patent
Veronneau

(10) Patent No.: US 7,396,152 B2
(45) Date of Patent: Jul. 8, 2008

(54) BLADELESS MIXER WITH PLANETARY MOTION

(75) Inventor: Germain Veronneau, Saint-Paul d'Abbotsford (CA)

(73) Assignee: G-Explore Ltee, Saint-Jean-sur-Richelieu (CA)

( * ) Notice: Subject to any disclaimer, the term of this patent is extended or adjusted under 35 U.S.C. 154(b) by 0 days.

(21) Appl. No.: 10/598,527

(22) PCT Filed: Mar. 16, 2005

(86) PCT No.: PCT/CA2005/000399

§ 371 (c)(1),
(2), (4) Date: Sep. 1, 2006

(87) PCT Pub. No.: WO2005/087358

PCT Pub. Date: Sep. 22, 2005

(65) Prior Publication Data

US 2007/0183252 A1 Aug. 9, 2007

(30) Foreign Application Priority Data

Mar. 16, 2004 (CA) ..... 2461269

(51) Int. Cl.
*B01F 9/22* (2006.01)

(52) U.S. Cl. ..... 366/217; 241/175

(58) Field of Classification Search ..... 366/139, 366/209–219, 272; 241/118, 123, 125, 175, 241/207; 433/49, 90–91; 494/19
See application file for complete search history.

(56) References Cited

U.S. PATENT DOCUMENTS

| | | | | | |
|---|---|---|---|---|---|
| 1,774,257 | A | * | 8/1930 | English | 366/217 |
| 3,559,956 | A | | 2/1971 | Gray | |
| 3,778,033 | A | | 12/1973 | Pullman | |
| 4,128,344 | A | * | 12/1978 | Blasetti | 366/348 |
| 4,131,369 | A | * | 12/1978 | Gordon et al. | 366/146 |
| 5,352,037 | A | | 10/1994 | Jouvin | |
| 5,487,606 | A | | 1/1996 | Keller | |

(Continued)

FOREIGN PATENT DOCUMENTS

EP 1218094 B1 4/2001

(Continued)

*Primary Examiner*—Charles E Cooley
(74) *Attorney, Agent, or Firm*—Buchanan Ingersoll & Rooney PC

(57) ABSTRACT

A bladeless mixer/mill for agitating and mixing a compound/product. The mixer/mill comprises a driving shaft rotatable about a first vertical axis of rotation, and a motor unit operatively coupled to the driving shaft for rotating the same. A support plate is mounted onto the driving shaft and is rotatable about the first vertical axis. The mixer/mill also has a stationary ring gear coaxial to the support plate. The stationary ring gear has a portion with an inner surface extending above the support plate. At least one pinion gear is rotatably mounted onto the support plate about a second vertical axis of rotation parallel to the first vertical axis of rotation. The pinion gear has an outer surface complementary to the inner surface of the stationary ring gear. The outer surface of the pinion gear meshes with the inner surface of the stationary ring gear. The pinion gear has a cavity wherein the compound/product to be agitated and mixed/milled is inserted.

20 Claims, 6 Drawing Sheets

U.S. PATENT DOCUMENTS 5,551,779 A 9/1996 Gantner et al.
5,702,183 A * 12/1997 Rasimus et al. ..... 366/195
5,746,510 A 5/1998 Mark et al.
6,334,583 B1 1/2002 Li
6,837,399 B1 1/2005 Wagner et al.
7,354,188 B2 * 4/2008 Uphus et al.
2007/0183252 A1 * 8/2007 Veronneau ..... 366/69

FOREIGN PATENT DOCUMENTS

JP 3-193127 * 8/1991
JP 2000-271465 10/2000
JP 2001-276592 10/2001
JP 2003-093862 4/2003

* cited by examiner

BLADELESS MIXER WITH PLANETARY MOTION

FIELD OF THE INVENTION

The present invention relates to a mixer, and more particularly to a mixer which can fully and uniformly mix and agitate compounds using a planetary-like motion.

BACKGROUND

Agitating and mixing compounds in a container is generally done with mixers having impellers producing a flow pattern within the container to achieve the desired results. These impellers are usually of the type straight-blade turbine radial flow, pitched-blade turbine mixed flow or hydrofoil impeller axial flow, depending of the flow pattern required. Dirty accumulations surrounding the work area are usually produced during the mixing process. Therefore, cleaning these mixers often require large quantity of solvents.

Moreover, although these known mixers are appropriate for mixing a large range of compounds, they are not suitable for some others because the impellers may create a lot of friction on the compounds, which can result in substance damage and change.

In addition, good mixing often requires that the impellers mix the content of the entire container, which can be a difficult task to accomplish. Mixing of compounds with these mixers can thus result in poor or uneven mixing of the compounds, poorly dispersed solid particles or their agglomeration.

Known in the art are Japanese Patents Nos 2003/093862 (HIROSHIGE), 2001/276592 (HIROSHIGE) and 2000/271465 (HIROSHIGE), which disclose apparatuses that fully agitate and mix compounds to be kneaded. The apparatuses disclosed in these patents use rotation and revolution to agitate and mix the compounds. These apparatus, also referred to as bladeless mixers, mix the compounds by simultaneously rotating a batch container and revolving it in a planetary motion, thus producing acceleration forces of 400 G and higher. The mixing principle underneath these apparatuses is generated by both centrifugal and centripetal forces. The advantage of such mixers is that they mixed liquids and powders evenly in seconds while imparting no heat. Since the containers are rotated at a predetermined angle, air may be entrapped within the containers. Therefore, once the mixing is complete, an additional step may be required to remove submicron bubbles present within the compounds. Another problem with these apparatuses is that they are very costly and complicated to build, due to their complex mechanical structure.

U.S. Pat. No. 6,334,583 (Li) discloses a planetary-like high-energy ball mill for milling powders. Two cup-like rollers are mounted onto a turntable that is driven in rotation by a vertical main shaft. A mill pot containing the powders to be mixed is fixed within each of the cup-like rollers. A stationary circular ring is mounted over the turntable and is disposed coaxially with the shaft. The cup-like rollers may rotate about their own pivotal shafts while rotating along with the turntable. Sides of the cup-like rollers are in contact with an inner surface of the stationary ring and are therefore rotating about their own pivotal axis due to friction counterforce with the stationary ring. A vertical movement may also be applied to the vertical shaft in order to further mill the powders. One potential problem with such a mill is that at a high velocity of rotation, control over the speed of rotation of the cup-like rollers may be lost if the cup-like rollers spin on themselves. As a result, the uniformity and quality of the milled powder may not be constant. Furthermore, in some cases, the frictional force required to drive into rotation the cup-like rollers upon beginning of rotation of the turntable may not be sufficient. Therefore, there may be a delay before the cup-like rollers may begin to rotate about their own pivotal axis.

SUMMARY OF THE INVENTION

An object of the present invention is to provide a bladeless mixer capable of overcoming at least one of the above-mentioned drawbacks and problems.

More specifically, a first object of the present invention is to provide a bladeless mixer which design is simple and cheap to mass produce.

Another object of the invention is to provide a bladeless mixer which considerably reduces the use of solvent for cleaning purposes.

A further object of the invention is to provide a bladeless mixer which improves the mixing of compounds disperses solid particles and reduces agglomeration of solid particles.

Still another object of the invention is to provide a bladeless mixer which is easy to operate and wherein the mixing of the compound is done over a short period of time.

Still another object of the invention is to provide a bladeless mixer which does not damage and change the compound.

Another object of the invention is to provide a bladeless mixer which avoids air entrapment within the container wherein the compound is inserted.

A further object of the invention is to provide a bladeless mixer providing a uniform and constant quality of a resulted mixed compound.

Still another object of the invention is to provide a bladeless mixer which may also be used as a miller for crushing solid particles in a fine powder by using a planetary-like motion.

In accordance with the present invention, the above objects are achieved with a bladeless mixer for agitating and mixing a compound. The mixer comprises a driving shaft rotatable about a first vertical axis of rotation, and a motor unit operatively coupled to the driving shaft for rotating the same. A support plate is mounted onto the driving shaft and is rotatable about the first vertical axis. The mixer also has a stationary ring gear coaxial to the support plate. The stationary ring gear has a portion with an inner surface extending above the support plate. At least one pinion gear is rotatably mounted onto the support plate about a second vertical axis of rotation parallel to the first vertical axis of rotation. The pinion gear has an outer surface complementary to the inner surface of the stationary ring gear. The outer surface of the pinion gear meshes with the inner surface of the stationary ring gear. The pinion gear has a cavity wherein the compound to be agitated and mixed is inserted.

In accordance with the present invention, the above objects are also achieved with a bladeless mill for producing a powder from a product. The mill comprises a driving shaft rotatable about a first vertical axis of rotation, and a motor unit operatively coupled to the driving shaft for rotating the same. A support plate is mounted onto the driving shaft and is rotatable about the first vertical axis. The mill also has a stationary ring gear coaxial to the support plate. The stationary ring gear has a portion with an inner surface extending above the support plate. At least one pinion gear is rotatably mounted onto the support plate about a second vertical axis of rotation parallel to the first vertical axis of rotation. The pinion gear has an outer surface complementary to the inner surface of the stationary ring gear. The outer surface of the pinion gear meshes with the inner surface of the stationary ring gear. The pinion gear has a cavity wherein the product to be milled is inserted.

Furthermore, there is also provided a method for agitating and mixing a compound using the bladeless mixer, comprising the steps of: a) inserting the compound into a container; b) securing the container into the cavity of one of said at least one pinion gear; c) agitating and mixing the compound in the container by actuating the motor unit for a predetermined time, thereby obtaining a mixed compound; and d) removing the mixed compound from the container.

The invention and its advantages will become more apparent upon reading of the following non-restrictive description of preferred embodiments thereof, given with reference to the accompanying drawings.

DETAILED DESCRIPTION OF PREFERRED EMBODIMENTS

Figure 1:
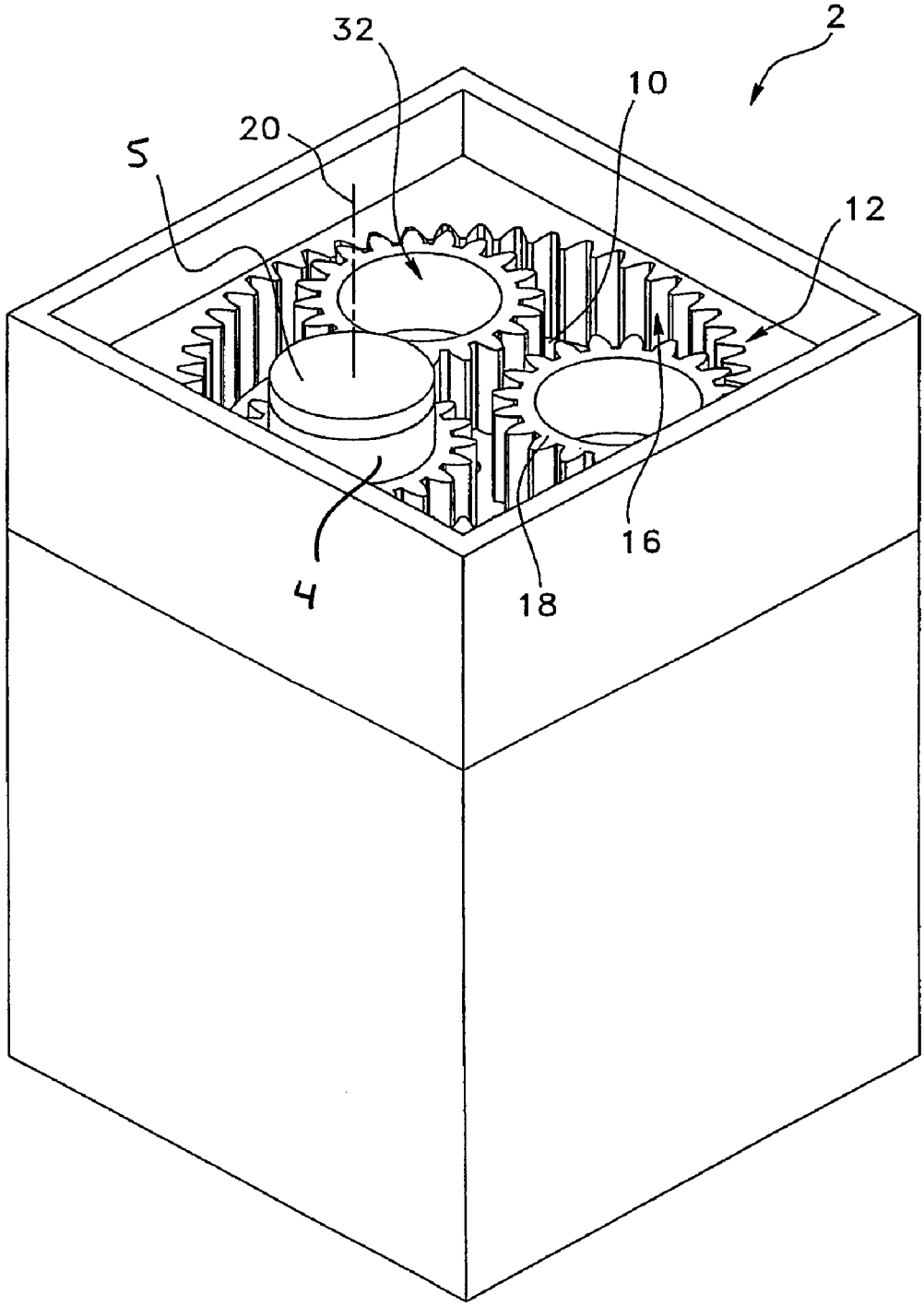
FIG. 1 is a perspective view of a bladeless mixer according to a first embodiment of the present invention.
Figure 2:
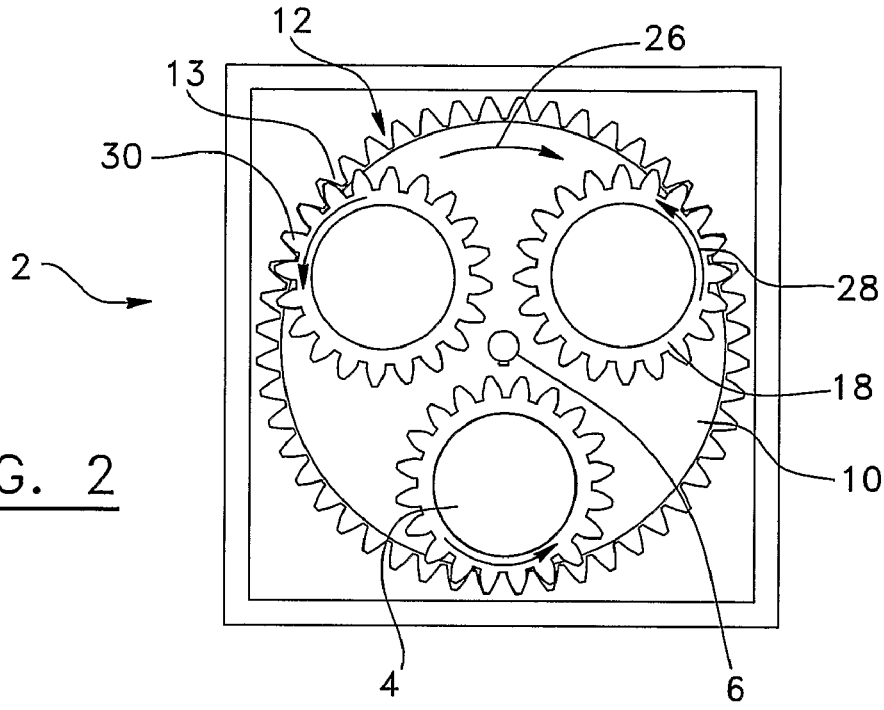
FIG. 2 is a top plan view of the bladeless mixer shown in FIG. 1.
Figure 3:
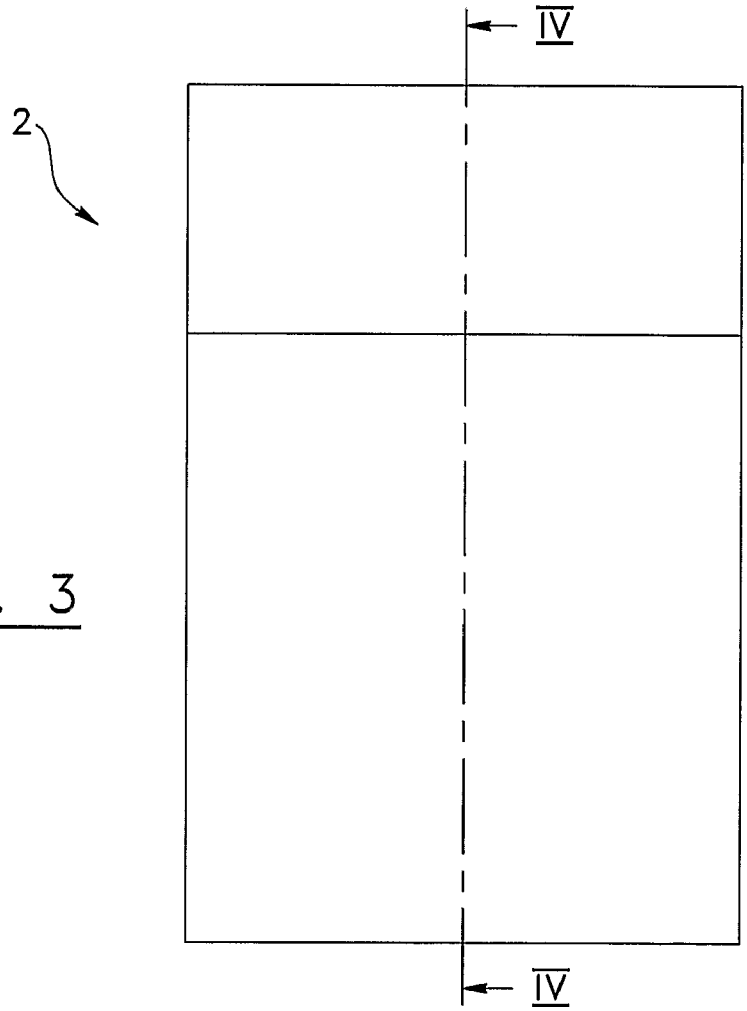
FIG. 3 is a side elevational view of the bladeless mixer shown in FIG. 1.

FIGS. 1 to 4 illustrate a bladeless mixer 2 according to a first preferred embodiment of the invention, which is devised to agitate and mix a compound and/or mill a product for producing powders.

The mixer 2 has a support plate 10 rotatably mounted onto a driving shaft 6 about a first axis 8 of rotation. A stationary ring gear 12 is coaxially mounted around the support plate 10 and has a portion 16 extending over the support plate 10. Preferably, the ring gear 12 has teeth 13 located on its inner surface. The support plate 10 is driven into rotation by the driving shaft 6. A motor unit 14 is operatively coupled to the driving shaft 6 in a driving engagement therewith.

The mixer 2 also has at least one pinion gear 18 rotatably mounted to the support plate 10 about a second axis 20 of rotation parallel to the first axis 8 of rotation. The pinion gear 18 has an outer surface complementary with the inner surface of the ring gear 12. The inner surface and the outer surface mesh together. Upon rotation of the driving shaft 6, the support plate 10 rotates in a direction depicted by arrow 26, and the pinion gear 18 rotates on itself about the second axis of rotation 20, but in a direction opposed to a rotation of the support plate 10, as depicted by arrow 28. The pinion gear 18 is preferably mounted onto the support plate 10 near the outer perimeter of the same to be submitted to a greater centrifugal force. Although the ring gear 12 and the pinion gear 18 illustrated have teeth 13, 30, it will be understood that other meshing surfaces may be used instead.

The pinion gear 18 has a cavity 32 wherein the compound to be mixed (or the product to be milled) is inserted. The pinion gear 18 may also have more than one cavity 32. Preferably, the cavity 32 is an upwardly opening cavity formed within the pinion gear 18. A container 4 containing the compound to be agitated and mixed is inserted in the cavity 32 in a tight-fitting manner, thus preventing great vibrations within the mixer 2. Of course, other securing devices, such as bolts and nuts (not shown), may be used for fixing the container 4 into the cavity 32 of the pinion gear 18. It is also possible to use an adaptor (not shown) to fit a smaller container 4 in a larger cavity 32. Instead of using the container 4, the cavity may be provided with a removable lid 32.

The container 4 may have a different shape than the one illustrated. For example, the container 4 may have a square shape, a circular shape, an oval shape or any other suitable shape. Of course, the cavity 32 may be designed to receive such containers 4 having different shapes.

At least one pinion gear 18 may be used for mixing compound(s) and/or milling product(s). However, in order to maximize the process, a plurality of pinion gears 18 with containers 4 is used to allow simultaneous agitation and mixing/milling of one or more compounds/products. According to the pinion gear configuration chosen, it may be necessary to add some weight, to balance the support plate 10.

Figure 4:
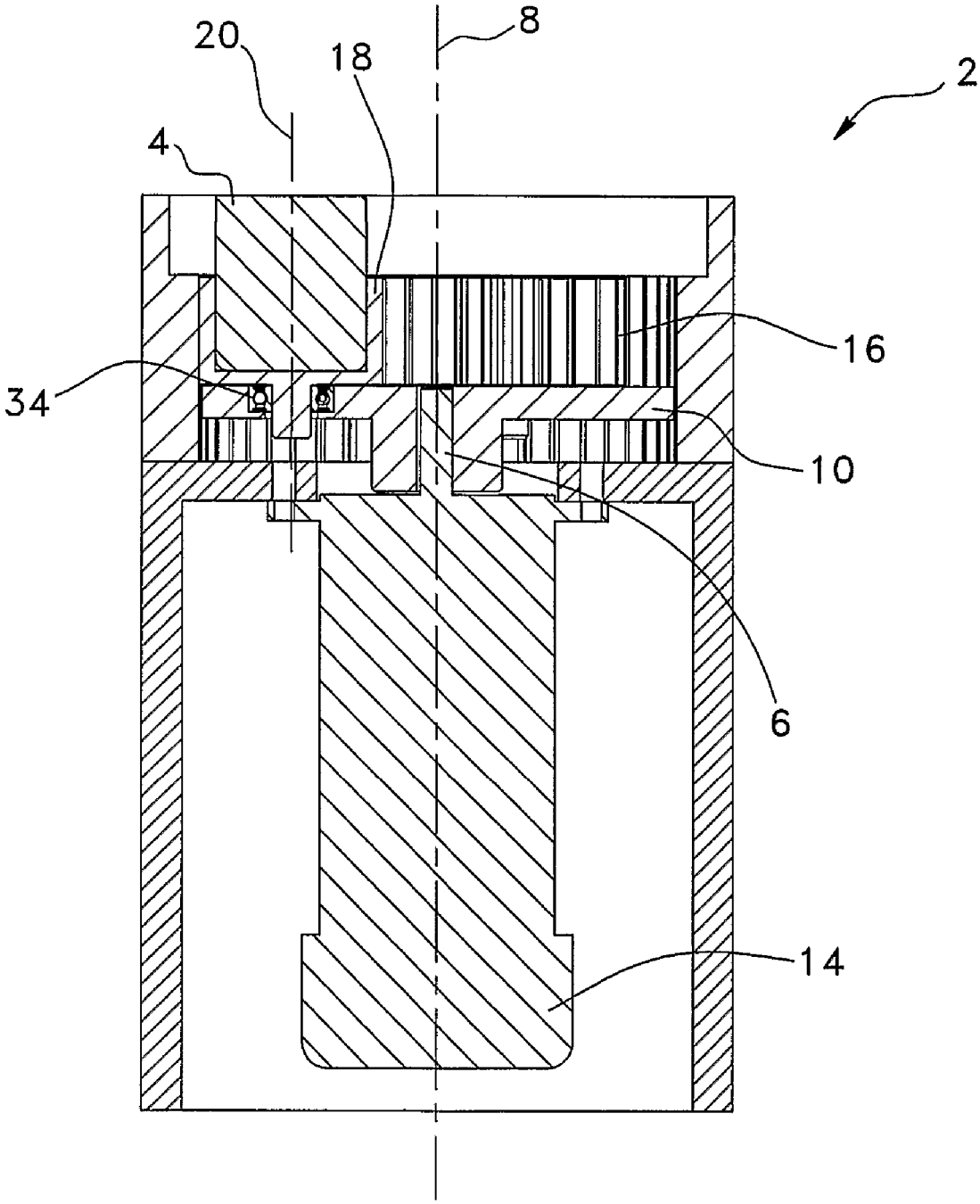
FIG. 4 is a cross-sectional view taken along the line IV-IV of the bladeless mixer shown in FIG. 3.
Figure 5:
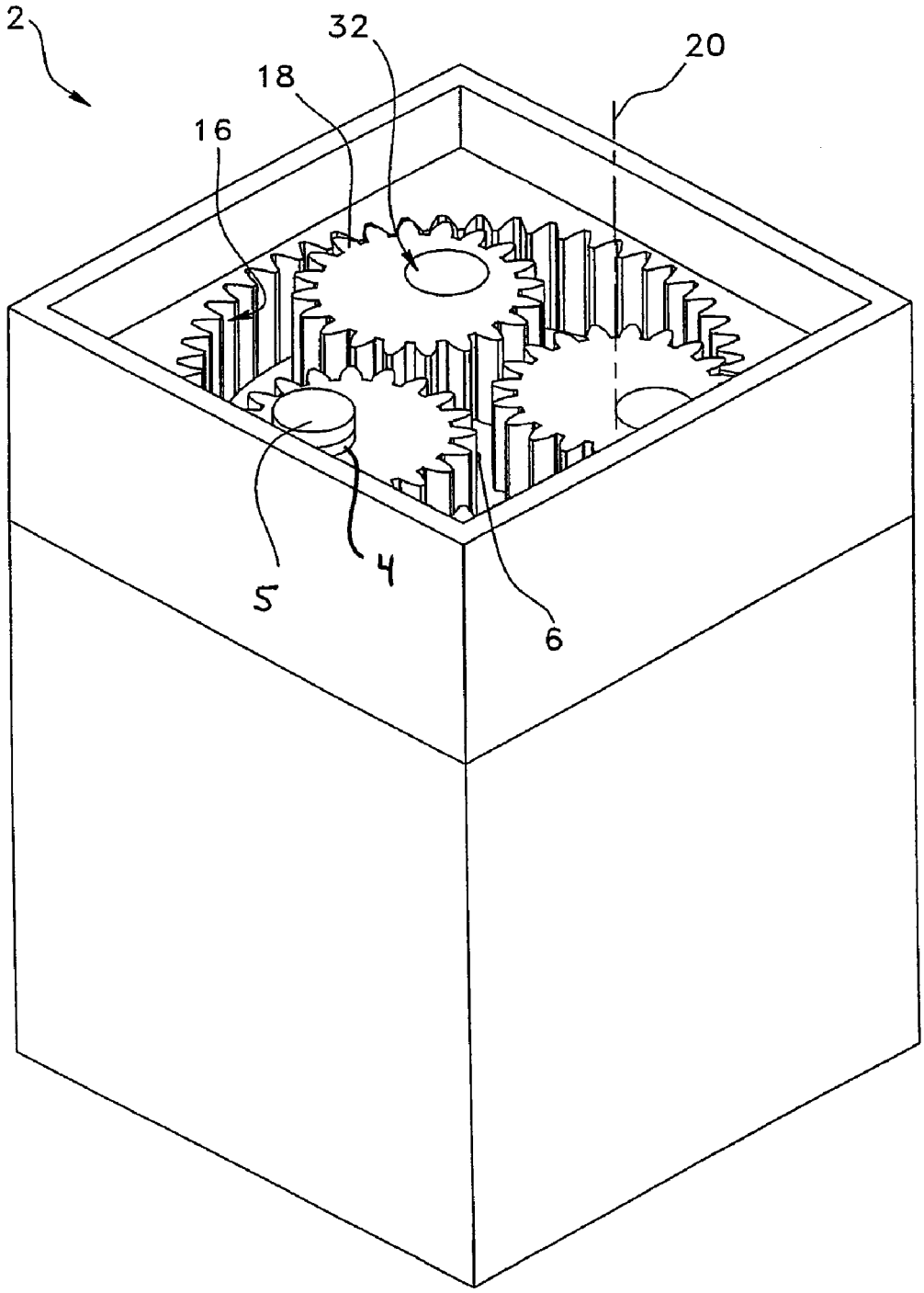
FIG. 5 is a perspective view of a bladeless mixer according to a second embodiment of the present invention.
Figure 6:
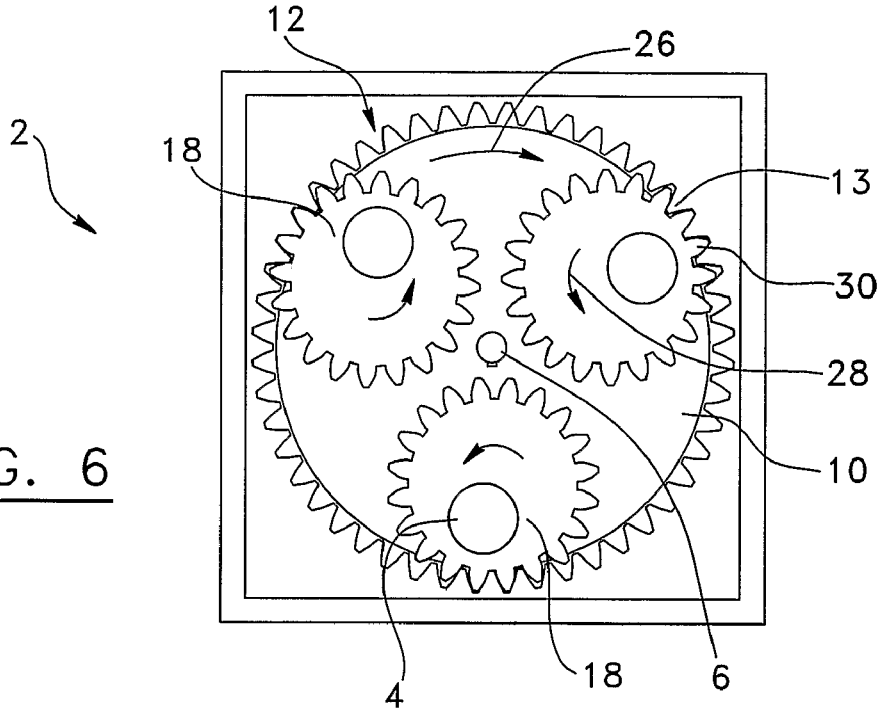
FIG. 6 is a top plan view of the bladeless mixer shown in FIG. 5.
Figure 7:
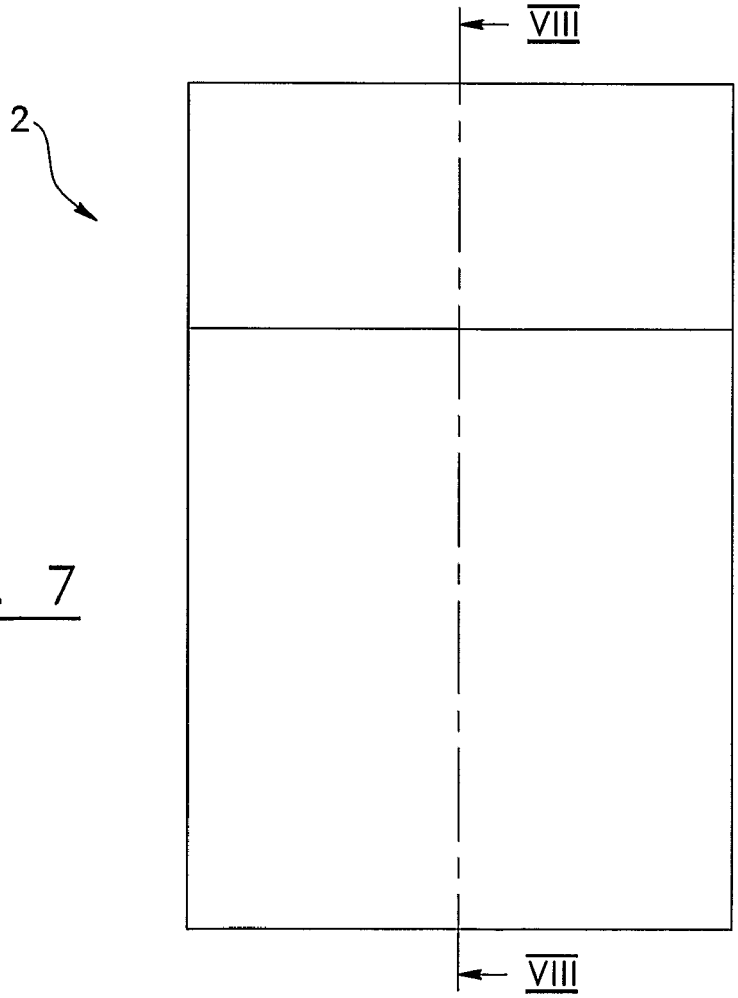
FIG. 7 is a side elevational view of the bladeless mixer shown in FIG. 5.

As shown in FIG. 4, the pinion gears 18 are rotatably mounted onto the support plate 10 through bearings 34 enabling the pinion gears 18 to rotate on themselves during rotation of the support plate 10.

The container 4 is preferably rotated in an upright position for avoiding air entrapment within the container 4. Therefore, there may be no need for an additional step to deaerate down submicron bubbles present within the compounds.

The rotation speed of the drive shaft 6 is controlled by the motor unit 14 to submit the containers 4 to predetermined G forces. In another preferred embodiment of the invention, the driving shaft 6 may be driven by a different motor arrangement for driving the support plate 10 in rotation at a desired speed.

There is no need to use a large quantity of solvents for cleaning the mixer 2 because there is no impeller in contact with the compound(s). Consequently, since there is no mechanical part directly in contact with the compounds, there is no undesired substance damage or change.

FIGS. 5 to 9 illustrate a second preferred embodiment of the bladeless mixer 2, wherein the cavity 32 is off-centered from the second axis of rotation 20. Therefore, the container 4 is also off-centred from the center of rotation of the cavity 32 and the container 4 is submitted to greater gravitational forces. This configuration generates a multi-planetary movement that may be referred as a molecular or electronic pattern.

Figure 9:
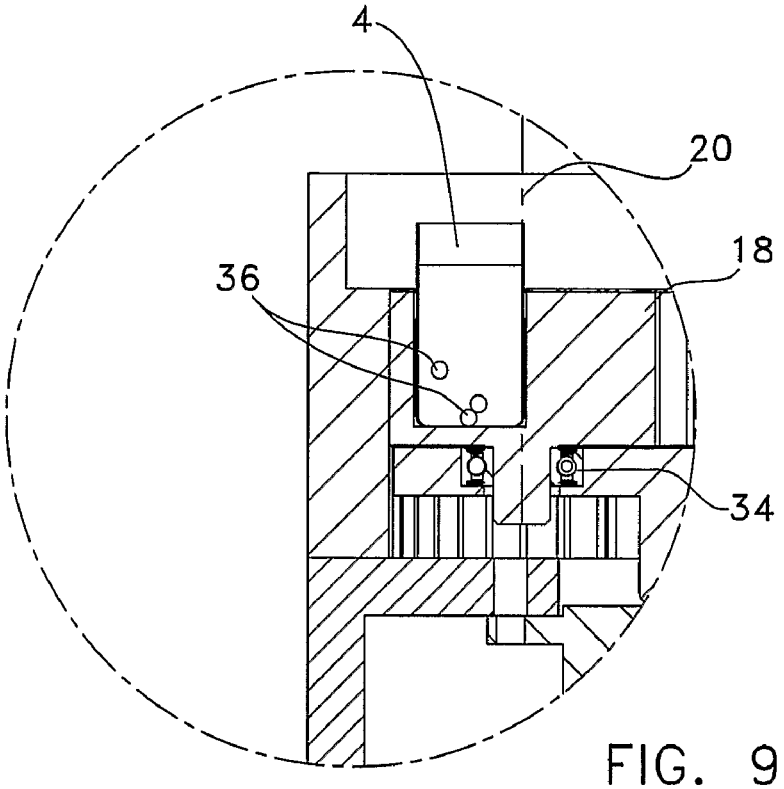
FIG. 9 is an enlarged view of a portion of the bladeless mixer shown in FIG. 8, illustrating a crushing device inserted within one of the containers.
Figure 8:
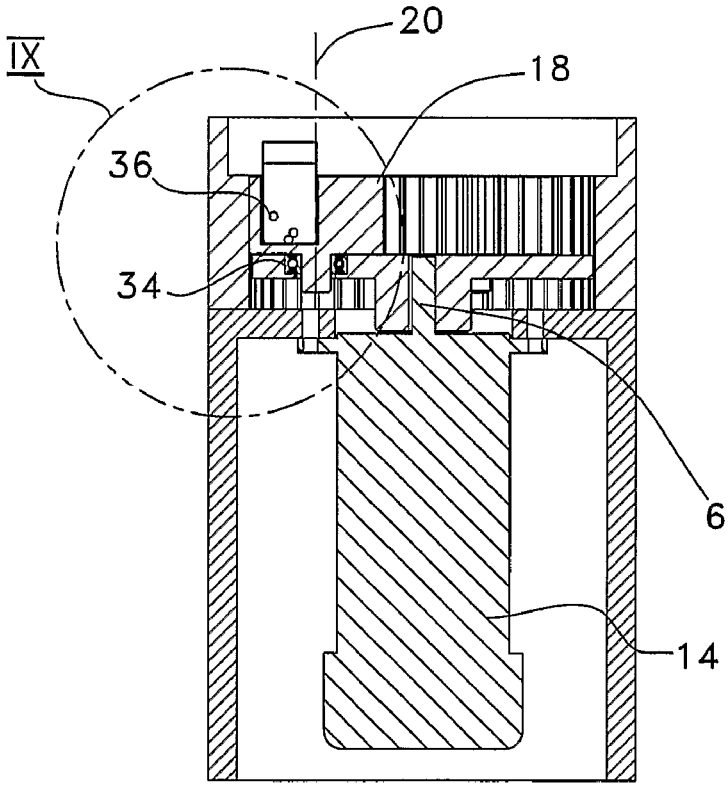
FIG. 8 is a cross-sectional view taken along the line VIII-VIII of the bladeless mixer shown in FIG. 7.

As better illustrated in FIG. 9 and as previously mentioned, the mixer 2 may also be used as a mill for producing a powder from a product. To that effect, the container 4 may incorporate crushing devices 36, such as balls or rolls, to better disperse solid particles into compounds and to provide increased deagglomeration of the solid particles. The crushing devices 36 also crush the solid particles into a fine powder.

In all possible embodiments of the present invention, the ring gear 12 and pinion gear 18 may be made of plastic, metal or any other material conventionally used for ring and pinion structures. Moreover, the speed at which the compound in the container 4 will be agitated and mixed may be modified by changing the ring-pinion gear ratio. Thus, a pinion gear 18 having a smaller diameter will rotate on itself at a higher speed of rotation than a pinion gear 18 having a greater diameter.

To agitate and mix a compound using the bladeless mixer 2, the following steps may be performed: inserting the compound into a container 4; securing the container 4 into the cavity 32 of one of the pinion gears 18; agitating and mixing the compound in the container 4 by actuating the motor unit 14 for a predetermined time, thereby obtaining a mixed compound; and removing the mixed compound from the container 4.

Although the present invention has been explained hereinabove by way of preferred embodiments thereof, it should be pointed out that any modifications to these preferred embodiments within the scope of the appended claims are not deemed to alter or change the nature and scope of the present invention.

For example, various containers 4 may be used depending of the compound to mix or product to mill. Mixing a compound or milling a product often creates a considerable amount of energy, therefore resulting in a potential explosion. The containers 4 may be design to prevent such explosion. Preferably, the containers 4 are airtight.

The invention claimed is:

1. A bladeless mixer for agitating and mixing a compound, the mixer comprising:

a driving shaft rotatable about a first vertical axis of rotation;

a motor unit operatively coupled to the driving shaft for rotation of the same;

a support plate mounted onto the driving shaft and rotatable about the first vertical axis;

a stationary ring gear coaxial to the support plate, said stationary ring gear having a portion with an inner surface extending above said support plate; and at least one pinion gear rotatably mounted to the support plate about a second vertical axis of rotation parallel to the first vertical axis of rotation, said at least one pinion gear having an outer surface complementary to the inner surface of the stationary ring gear, the outer surface of the pinion gear meshing with the inner surface of the stationary ring gear, the pinion gear having a cavity wherein the compound to be agitated and mixed is inserted.

2. The bladeless mixer according to claim 1, wherein the cavity of each of said at least one pinion gear has a removable lid.

3. The bladeless mixer according to claim 1, wherein the cavity of each of said at least one pinion gear is located at a position off-centered from the second axis of rotation.

4. The bladeless mixer according to claim 1, wherein the cavity of each of said at least one pinion gear is an upwardly opening cavity wherein a container containing the compound to be agitated and mixed is inserted in a tight-fitting manner.

5. The bladeless mixer according to claim 4, wherein the upwardly opening cavity of each of said at least one pinion gear is located at a position off-centered from the second vertical axis of rotation.

6. The bladeless mixer according to claim 5, further comprising at least one airtight container shaped for tight-fitting into the upwardly opening cavity.

7. The bladeless mixer according to claim 4, further comprising at least one airtight container shaped for tight-fitting into the upwardly opening cavity.

8. The bladeless mixer according to claim 1, further comprising two additional pinion gears mounted onto the support plate at equidistant positions from each others and from the at least one pinion gear.

9. The bladeless mixer according to claim 8, wherein the cavity of each of said at least one pinion gear is an upwardly opening cavity wherein a container containing the compound to be agitated and mixed is inserted in a tight-fitting manner.

10. The bladeless mixer according to claim 9, wherein the upwardly opening cavity of each of said at least one pinion gear is located at a position off-centered from the second axis of rotation.

11. The bladeless mixer according to claim 10, further comprising at least one airtight container shaped for tight-fitting into the upwardly opening cavity.

12. The bladeless mixer according to claim 9, further comprising at least one airtight container shaped for tight-fitting into the upwardly opening cavity.

13. A method for agitating and mixing a compound using a bladeless mixer comprising a driving shaft rotatable about a first vertical axis of rotation; a motor unit operatively coupled to the driving shaft for rotation of the same; a support plate mounted onto the driving shaft and rotatable about the first vertical axis; a stationary ring gear coaxial to the support plate, said stationary ring gear having a portion with an inner surface extending above said support plate; and at least one pinion gear rotatably mounted onto the support plate about a second vertical axis of rotation parallel to the first vertical axis of rotation, said at least one pinion gear having an outer surface complementary to the inner surface of the stationary ring gear, the outer surface of the pinion gear meshing with the inner surface of the stationary ring gear, the pinion gear having a cavity wherein the compound to be agitated and mixed is inserted, the method comprising the steps of:

a) inserting the compound into a container;

b) securing the container into the cavity of one of said at least one pinion gear;

c) agitating and mixing the compound in the container by actuating the motor unit for a predetermined time, thereby obtaining a mixed compound; and d) removing the mixed compound from the container.

14. A bladeless mill for producing a powder from a product, the mill comprising:

a driving shaft rotatable about a first vertical axis of rotation;

a motor unit operatively coupled to the driving shaft for rotation of the same;

a support plate mounted onto the driving shaft and rotatable about the first vertical axis;

a stationary ring gear coaxial to the support plate, said stationary ring gear having a portion with an inner surface extending above said support plate; and at least one pinion gear rotatably mounted to the support plate about a second vertical axis of rotation parallel to the first vertical axis of rotation, said at least one pinion gear having an outer surface complementary to the inner surface of the stationary ring gear, the outer surface of the pinion gear meshing with the inner surface of the stationary ring gear, the pinion gear having a cavity wherein the product to be milled is inserted.

15. The bladeless mill according to claim 14, wherein said at least one pinion gear comprises a crushing device inserted within its cavity.

16. The bladeless mill according to claim 14, wherein the cavity of each of said at least one pinion gear has a removable lid.

17. The bladeless mill according to claim 14, wherein the cavity of each of said at least one pinion gear is located at a position off-centered from the second vertical axis of rotation.

18. The bladeless mill according to claim 14, wherein the cavity of each of said at least one pinion gear is an upwardly opening cavity wherein a container containing the compound to be agitated and mixed is inserted in a tight-fitting manner.

19. The bladeless mill according to claim 18, wherein the upwardly opening cavity of each of said at least one pinion gear is located at a position off-centered from the second axis of rotation.

20. The bladeless mill according to claim 18, further comprising at least one airtight container shaped for tight-fitting into the upwardly opening cavity.

* * * * *